US011124325B2

(12) United States Patent
Kirsch et al.

(10) Patent No.: US 11,124,325 B2
(45) Date of Patent: Sep. 21, 2021

(54) PACKAGING MACHINE WITH A CUTTING DEVICE WITH OPTIMIZED POWER CONSUMPTION

(71) Applicant: Bizerba SE & Co. KG, Balingen (DE)

(72) Inventors: Sascha Kirsch, Burladingen (DE); Franz Heller, Herrenberg (DE); Eugen Elis, Rohrdorf (DE)

(73) Assignee: Bizerba SE & Co. KG, Balingen (DE)

( * ) Notice: Subject to any disclaimer, the term of this patent is extended or adjusted under 35 U.S.C. 154(b) by 221 days.

(21) Appl. No.: 16/542,320

(22) Filed: Aug. 16, 2019

(65) Prior Publication Data

US 2020/0062436 A1 Feb. 27, 2020

(30) Foreign Application Priority Data

Aug. 21, 2018 (EP) ..... 18 189 912

(51) Int. Cl.
*B65B 57/00* (2006.01)
*B65B 61/06* (2006.01)
*B65B 11/00* (2006.01)

(52) U.S. Cl.
CPC ..... *B65B 61/06* (2013.01); *B65B 57/00* (2013.01); *B65B 11/00* (2013.01); *B65B 2220/06* (2013.01)

(58) Field of Classification Search
CPC ..... B65B 61/00; B65B 61/04; B65B 61/06; B65B 11/00; B65B 2220/06; B26D 7/26
USPC ..... 53/389.3
See application file for complete search history.

(56) References Cited

U.S. PATENT DOCUMENTS 4,624,169 A * 11/1986 Nelson ..... B26D 3/085 33/1 M
5,014,489 A * 5/1991 Terminella ..... B65B 61/28 53/228

FOREIGN PATENT DOCUMENTS

DE 1922327 U 8/1965
DE 69705175 T2 2/2002
DE 102004029430 A1 * 1/2006 ..... B65B 51/303
DE 102004029430 A1 1/2006
EP 3093244 A1 11/2016

* cited by examiner

*Primary Examiner* — Chelsea E Stinson
(74) *Attorney, Agent, or Firm* — Leydig, Voit & Mayer, Ltd.

(57) ABSTRACT

A packaging machine packages items using film. The packaging machine includes: a film transporter for feeding film; and a cutting device for cutting film. The cutting device is transferrable by a driving force from a rest position into an extended position. The film is severable by the cutting device in the extended position. The cutting device is connected to a housing surrounding the cutting device via a return mechanism. The return mechanism is activatable upon the cutting device being transferred from the rest position into the extended position. A return force in a direction of the rest position is exertable by the return mechanism in the activated state on the cutting device in its extended position, the force being greater than a return resistance of the cutting device in its extended state by which the cutting device is held in the extended state without action of the driving force.

20 Claims, 7 Drawing Sheets

PACKAGING MACHINE WITH A CUTTING DEVICE WITH OPTIMIZED POWER CONSUMPTION

CROSS-REFERENCE TO RELATED APPLICATIONS

Priority is claimed to European Patent Application No. EP 18 189 912.1, filed on Aug. 21, 2018, the entire disclosure of which is hereby incorporated by reference herein.

FIELD

The present invention relates to a packaging machine for packaging items by means of a stretchable film.

BACKGROUND

EP 3 093 244 B1 discloses a packaging machine for packaging items by means of films, wherein the film is cut to size with a film trimming device or cutting device.

A high-performance stretch-film packaging machine can package more than 35 packaging items, in particular large tray shells, per minute. In the case of small tray shells, machines of very high performance can also handle more than 40, even up to 50, packages per minute, depending on the package size.

In order to package a packaging item, the following steps are carried out:

The packaging item is picked up and weighed.

Film from a film supply is fed through the film feeder to a film transport device, in particular taking the form of conveyor belts, and is then used to package a packaging item. The film is cut to size by the cutting device. To cut the film to size, the blade of the cutting device is transferred by the drive from the rest position into the extended position.

The film comes in particular from an "endless roll" and is unrolled therefrom. Once a required length of film is reached for a packaging operation, that section of the film must be separated from the endless film. The blade is used when cutting the film off the endless roll. Cutting a stretch film in particular is made more difficult by the fact that a stretch film is typically comparatively thin and, due to its stretching properties, easily just wraps around the blade without being cut through.

The packaging item is raised by a lifting table and pressed up beneath the film.

The film is pushed under the packaging item by the lateral sliders on the left and right simultaneously. Furthermore, the film is pushed under the packaging item from the rear by the rear slider.

The packaging item is labeled and pushed onto the sealing tape, wherein the front section of the film is pushed under the package.

The film is sealed on the underside of the tray shell and the packaged item is ejected.

Typically, during the cutting to size of the film, a blade of the cutting device is moved through the film, resulting in a relatively slow cutting operation. For a rapid cutting operation, the cutting device is moved up to the film by the drive before the cutting operation, cuts through the film over its full width, and is moved away from the film after the cutting operation.

The use of the drive for moving the cutting device in the two directions—towards the film and away from the film—requires a rapid switch-over of the drive and a high associated energy consumption.

SUMMARY

An embodiment of the present invention provides a packaging machine that packages items using a stretchable film. The packaging machine includes: a film transporter for feeding the stretchable film to a packaging item to be packaged; and a cutting device with a blade for cutting the stretchable film from the film transporter to size. The cutting device is transferrable by a drive with a driving force from a rest position into an extended position. The stretchable film is severable by the cutting device in the extended position. The cutting device is connected to a housing surrounding the cutting device via a return mechanism spatially separate from the drive. The return mechanism is activatable upon the cutting device being transferred from the rest position into the extended position. A return force in a direction of the rest position is exertable by the return mechanism in the activated state on the cutting device in its extended position, the force being greater than a return resistance of the cutting device in its extended state by which the cutting device is held in the extended state without action of the driving force.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
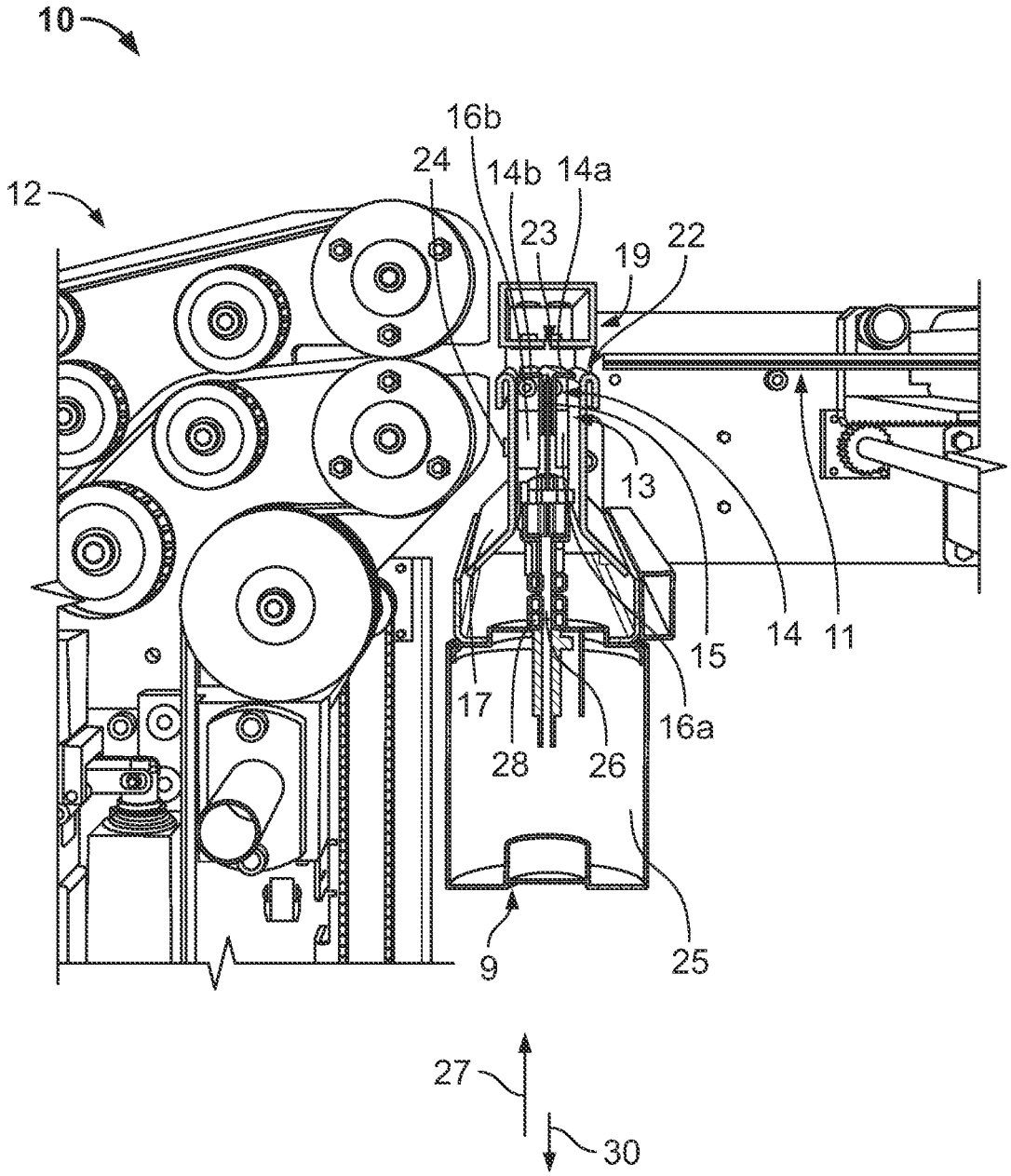
FIG. 1 is a longitudinal section through a film transfer point of a packaging machine.

Embodiments of the present invention modify not only a packaging machine but also a packaging method such that retraction of the cutting device (or cutter) is effected without any action on the part of the drive, preferably automatically.

Embodiments of the present invention improve upon the state of the art packaging machines in a technically particularly simple and surprisingly effective manner, for example the cutting device is connected to a housing surrounding the cutting device via a return mechanism spatially separate from the drive. The return mechanism can be activated with the transfer of the cutting device from the rest position into the extended position. A return force in the direction of the rest position can be applied in the extended position by the return mechanism in the activated state. The return force is greater than the return resistance of the cutting device in the extended state, by which the cutting device is held in the extended state without the application of the drive force.

Among other things, blades can press on the film with a cutting edge having the full width of the film. In order to cut the film through, the blade is pressed onto the film over its full width by means of an electric motor or a solenoid. After the cutting operation, the blade is retracted by the electric motor or the solenoid. The blade is possibly retracted by means of a spring support. A tension spring is used in particular in the case of a spring support. A tension spring can be tensioned and released three to five times per minute. Retracting the blade using only the force of a tension spring is not possible. The blade drive, in particular in the form of the electric motor or solenoid, always acts in both directions, not only during the movement of the blade towards the film but also during the movement of the blade away from the film.

In contrast, retraction from the extended position into the rest position is effected by the return mechanism according to the invention against the return resistance of the cutting device, wherein the return mechanism does not require the drive. The return resistance comprises all forces, excluding the force of the drive, which act on the cutting device in the extended state and oppose a return of the cutting device. These forces in particular include frictional and inertial forces. The drive can be of a mechanical, electrical or magnetic design. The return mechanism here allows the drive to act only in the cutting direction of the blade, the blade guide being transferred in the cutting direction from the rest position into the extended position. The drive is then preferably disengaged or switched off. The return mechanism then effects an automatic retraction of the cutting device from the extended position into the rest position counter to the cutting direction.

An advantageous embodiment of the packaging machine according to the invention is characterized in that the return mechanism has a first elastic element, which is fastened in particular indirectly to the blade of the cutting device. The first elastic element fastened to the blade can be brought into a tensioned form by the movement of the cutting device from the rest position into the extended position. As a result, the force required for returning the cutting device to the rest position is built up. The return then takes place automatically with the relaxation of the elastic element.

A preferred development of this embodiment is characterized in that the first elastic element is designed as a compression spring and is preferably connected to the cutting device by means of a rod. Compression springs are characterized by a high loading capacity and spring constants in comparison with other springs, such as tension springs. They can be used when there is rapid repetition and with strong spring forces to return the blade guide into the rest position. The rod is preferably passed through the compression spring. A compression spring can be tensioned and relieved up to a hundred times a minute.

In a class of further advantageous embodiments of the invention, the cutting device comprises a blade guide, in particular comprising one or more guide plates, preferably in the form of two mutually opposite guide plates. The control of the movement of the blade is considerably improved by a blade guide.

In preferred developments of this class of embodiments, the return mechanism has a second elastic element, in particular in the form of a leaf spring, which is fastened at one end to the blade guide and at the other end to the blade. The movement of the blade guide and of the blade can be coupled by a second elastic element, which connects the blade guide and the blade, so that the blade guide is automatically moved along with a movement of the blade. The use of an elastic element here makes different settings possible for the blade and the blade guide relative to one another.

A preferred variant of these developments is characterized in that the blade can be transferred from a first blade position within the blade guide into a second blade position by tensioning the second elastic element, in which second blade position the blade projects beyond the blade guide and in which the blade can be transferred from the second blade position back into the first blade position by relaxing the second elastic element. The blade preferably cuts through the film during the transition from the first blade position into the second blade position. The movement of the blade in the cutting direction is preferably controlled by the drive, the blade guide being held back by a stop. As a result of the tensioning of the second elastic element, in particular of the leaf spring, a spring force is built up which is opposite to the cutting direction. After the drive is switched off, this spring force retracts the blade back into the first blade position. By relaxing the first elastic element, the blade can then in particular be returned to the rest position of the blade guide by means of a tappet, which carries along the blade guide.

Further advantageous embodiments of the packaging machine according to the invention are characterized in that the film feeder has a film guide element with a cutting gap which is separated from the cutting device in the rest position by a film feed gap, the cutting device in the extended position resting against the film guide element. The film preferably rests against the film guide element and is pressed against the film guide element by the cutting device. Deformation of the film, in particular of an elastic film, is thereby prevented. This allows a precise cutting of the film to length.

A further development of these embodiments is characterized in that in the extended position of the cutting device, in particular of the blade guide, the blade projects through the cutting gap of the film guide element. In particular, in the extended position of the blade guide, the blade can be transferred, preferably by the drive, from the first blade position into the second blade position, whereby it passes through the cutting gap while the blade guide abuts against the film guide element. When the blade is transferred from the first blade position into the second blade position, the blade cuts through the film. After the film has been cut through, the blade can be returned automatically by the second elastic element to the first blade position, in particular by switching off the drive.

In a further development of the packaging machine according to the invention, said packaging machine comprises further elastic elements, in particular in the form of at least one further compression spring and/or at least one further leaf spring. As a result, the return forces can be amplified and a failure of an elastic element can be compensated.

A preferred development of the packaging machine is characterized in that the blade guide has at least one slide guide, in particular two slide guides, for at least one slide block formed on the blade, in particular two slide blocks. The slide blocks are preferably located on the housing, which surrounds the cutting device, and thus serve to center the blade.

A further development of this embodiment is characterized in that at least one, in particular a circular, spacer is arranged on the blade guide between the blade guide and the housing surrounding the cutting device, which can be guided along the housing of the cutting device during the transfer of the cutting device from the rest position into the extended position, two spacers in particular being arranged opposite each other on the blade guide. Centering of the blade guide is effected by these spacers.

A particularly preferred variant of this class of developments is characterized in that the slide block is arranged on the housing, extends through the spacer and engages in the slide guide of the blade guide, wherein in particular one slide block in each case reaches through two mutually opposite spacers and engages in each case one slide guide of the blade guide. The slide block or the slide blocks then limit the displacement of the blade guide in the cutting direction.

A further development is characterized in that the film guide element has contact faces at the cutting gap, in particular rubber lips, for the attachment of the film. The elastic counterforce of the rubber lips allows the film to be clamped particularly well between the rubber lips and the blade guide, which in its extended position presses against the rubber lips.

In a further advantageous embodiment of the packaging machine according to the invention, the drive has a pressure magnet which preferably acts only in the cutting direction of the cutting device. The pressure magnet in particular takes the form of a solenoid, linear magnet and/or electromagnet. The pressure magnet effects in particular a linear movement. However, the force of the pressure magnet acts only in the cutting direction, from the rest state of the cutting device into the extended state. After extension of the blade guide and of the blade it can be switched off, wherein the return mechanism brings about an automatic return of the blade and the blade guide into the rest position.

Another preferred embodiment, finally, is characterized in that the drive and/or the return mechanism has coupling elements—in particular U-shaped ones—for connection to the blade, which can preferably be inserted into recesses in the blade guide. The U-shaped coupling elements grip around the blade and can then be fastened to the blade in a simple manner by bolts guided through the blade. The coupling elements are formed on rods of the pressure magnet, of the first elastic element and/or on the second elastic element in each case in order to form a mechanical connection to the blade.

Other features and advantages of the invention arise from the following detailed description of an exemplary embodiment of the invention with reference to the figures in the drawing, which shows details essential to the invention, and also from the claims. The individual features can be implemented individually or combined in any combination in variants of the invention.

In the schematic drawing, an exemplary embodiment of the invention is shown which is explained in more detail in the following description.

FIG. 1 shows a longitudinal section through a film transfer point as part of a packaging machine 10. The packaging machine 10 comprises a film feeder 11, through which film from a film supply is fed to a film transport device (or film transporter) 12. The film transport device 12 conveys the film to the location where a packaging item is packaged. Between the film feeder 11 and the film transport device 12 there is a cutting device (or cutter) 13 according to the invention for cutting the film to length.

The cutting device 13 has a blade guide 14 in the form of two guide plates 14*a*, 14*b* opposite each other. Between the guide plates 14*a*, 14*b* there is a blade 15. The blade 15 and the blade guide 14 are connected elastically to each other (see FIG. 5). Circular spacers 16*a*, 16*b* for maintaining the distance between the guide plates and a housing 17 of the cutting device 13 that surrounds the cutting device 13 are attached to the guide plates 14*a*, 14*b*. The blade 15, the guide plates 14*a*, 14*b* and the circular spacers 16*a*, 16*b* form a sandwich-like structure.

Opposite the cutting device 13 is a film guide element (or film guide) 19 with contact faces 20*a*, 20*b* (see FIG. 2) in the form of rubber lips for attaching the film. A film feed gap 22 for feeding through the film is formed between the cutting device 13 and the film guide element 19. The guide plates 14*a*, 14*b* are pressed against the contact faces 20*a*, 20*b* during the cutting of the film (see FIG. 3). The contact surfaces 20*a*, 20*b* are arranged around a cutting gap 23 through which the blade 15 can pass for cutting the film (cf. FIG. 4).

Fastened to the housing 17 is at least one screw 24 which passes through at least one spacer 16*b* and engages in at least one recess of a guide plate 14*b*. This limits a displacement of the blade guide 14 to the length of the recess in the guide plate 14*a*, 14*b*.

A drive 9, in the form of a pressure magnet 25, via a pressure-magnet rod 26, moves the cutting device 13 only in a cutting direction 27 toward the film guide element 19. On the pressure-magnet rod 26 there is a stop 28 of the pressure-magnet rod 26, said stop bearing against the housing 17 of the cutting device 13. The pressure magnet 25 in particular takes the form of a solenoid, a linear magnet or an electromagnet, which acts only in the cutting direction 27. The movement of the blade guide 14 in the direction 30 opposite the cutting direction 27 is effected by a return mechanism according to the invention (see FIG. 2).

Figure 2:
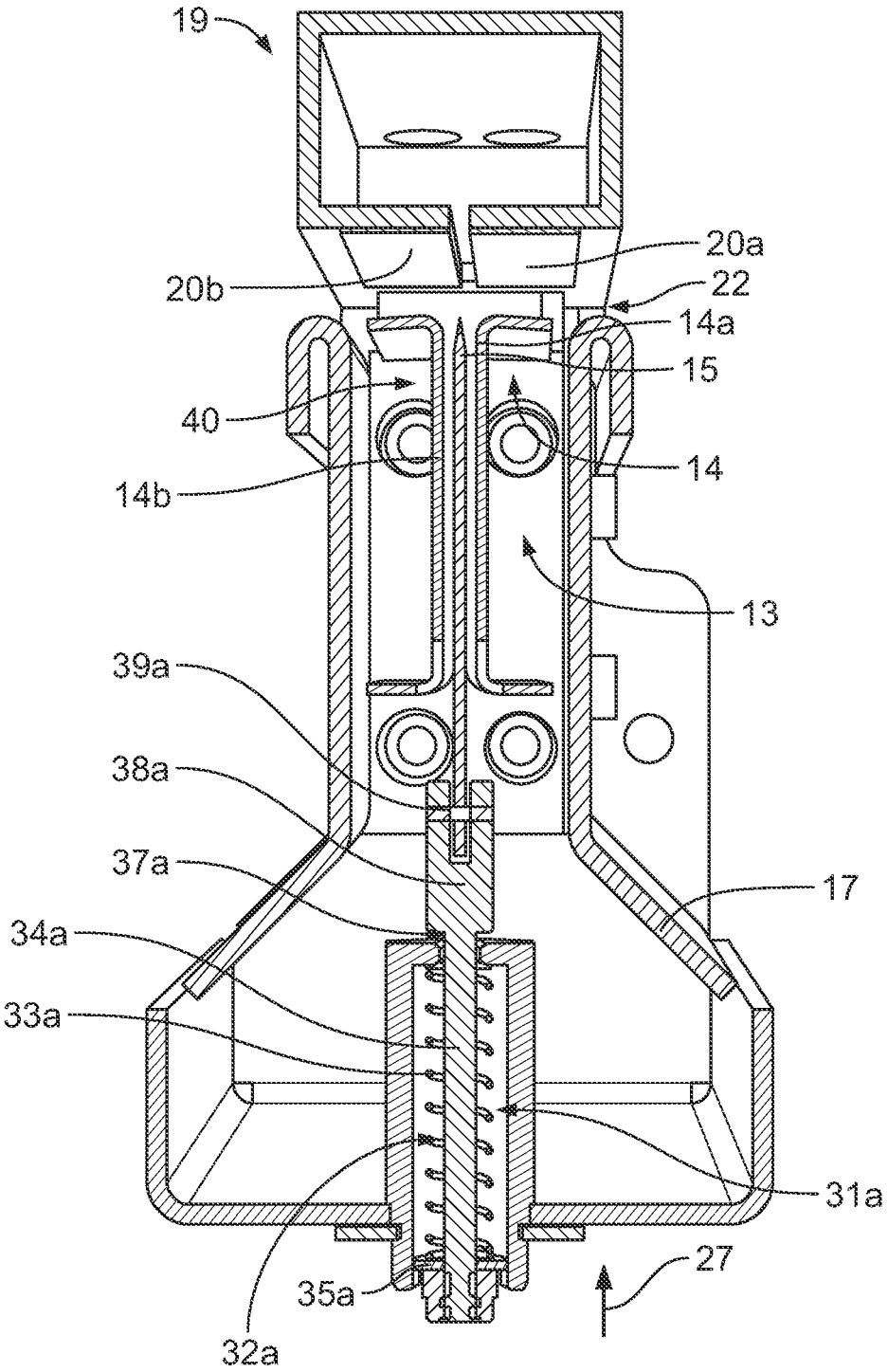
FIG. 2 is longitudinal section through the film guide element and the cutting device with a return mechanism according to the invention in the rest position and the blade in the first blade position.

FIG. 2 shows a longitudinal section through the film guide element 19 and the cutting device 13 with a return mechanism according to the invention 31*a*. The return mechanism 31*a* is arranged along the guide plates 14*a*, 14*b* offset from the pressure magnet 25 (see FIG. 5). The cutting device 13 has the blade guide 14 in the form of the guide plates 14*a*, 14*b* and the blade 15 arranged between the guide plates 14*a*, 14*b*. The return mechanism 31*a* comprises a first elastic element 32*a* in the form of a compression spring 33*a* around a rod 34*a* of the return mechanism 31*a* where a stop 35*a* for the compression spring 33*a* is arranged. The compression spring 33*a* and the rod 35*a* are arranged in the housing 17 of the cutting device 13. The housing 17 can have a single- or multi-part design. The rod 34*a* has at one end 37*a* a U-shaped coupling element 38*a*, which is permanently connected to the blade 15 via a bolt 39*a* passing through the blade 15.

The cutting device 13 is in a rest position 40. The film feed gap 22 is formed between the cutting device 13 and the film guide element 19 with the contact faces 20*a*, 20*b*. In the case of a movement of the cutting device 13 in the cutting direction 27 toward the film guide element 19 that is effected by the pressure magnet 25 (see FIG. 1), the compression spring 33*a* is pressed against the housing 17 and compressed. It then acts on the stop 35*a* with a force which is opposite to the cutting direction 27. After the pressure magnet 25 is switched off, the compression spring 33*a* relaxes, as a result of which the cutting device 13 is returned to the resting position 40.

Figure 3:
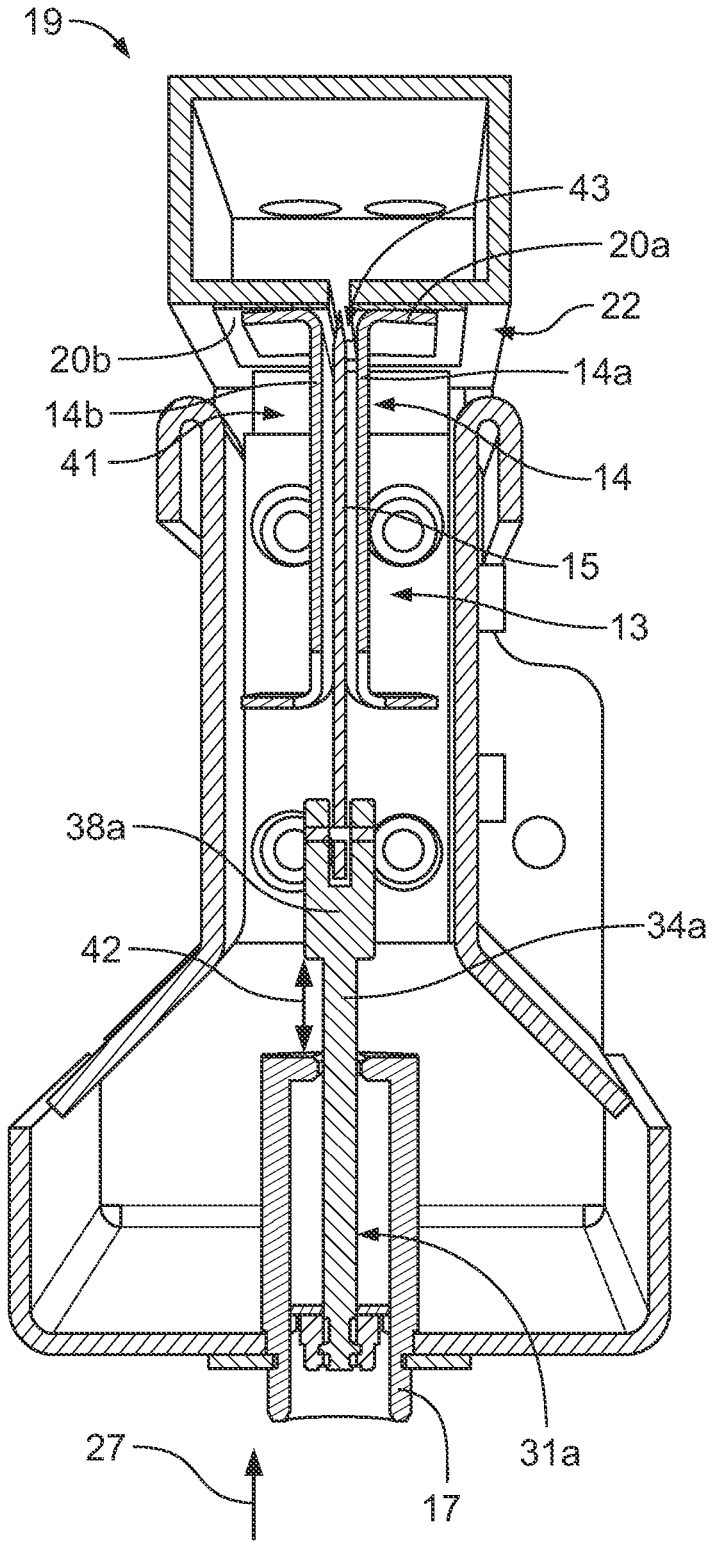
FIG. 3 is a longitudinal section through the film guide element and the cutting device, wherein the cutting device is in the extended position and the blade is in the first blade position.

FIG. 3 shows a longitudinal section through the film guide element 19 and the cutting device 13, the cutting device 13 being in an extended position 41. The two guide plates 14*a*, 14*b* bear against the contact faces 20*a*, 20*b* of the film guide element 19 while bridging the film feed gap 22. The rod 34*a* of the return mechanism 31*a* is extended, and a separation 42 in the cutting direction 27 is created between the housing 17 of the cutting device 13 and the U-shaped coupling element 38*a*. The blade 15 is arranged in a first blade position 43 within the blade guide 14 between the two guide plates 14*a*, 14*b*.

Figure 4:
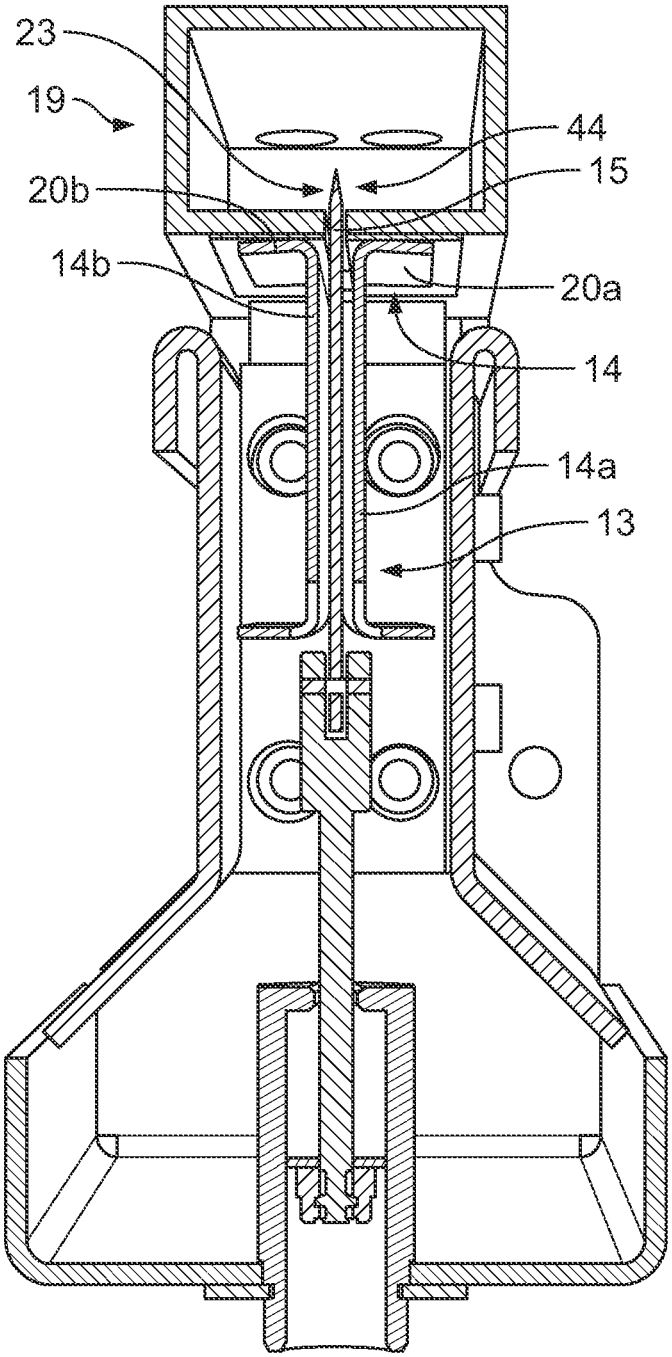
FIG. 4 is a longitudinal section through the film guide element and the cutting device, wherein the cutting device is in the extended position and the blade is in the second blade position.

FIG. 4 shows a longitudinal section through the film guide element 19 and the cutting device 13, the blade 15 being in a second blade position 44. The blade guide 14 in the form of the two guide plates 14*a*, 14*b* bears against the contact faces 20*a*, 20*b* of the film guide element 19. In the second blade position 44, the blade 15 reaches between the two guide plates 14*a*, 14*b* of the blade guide 14, passing through the cutting gap 23 of the foil guide element 19. During the transition from the first blade position 43 (see FIG. 3) to the second blade position 44, due to the driving force of the pressure magnet 25 (see FIG. 1) the blade 15 severs the film attached to the film guide element 19.

Figure 5:
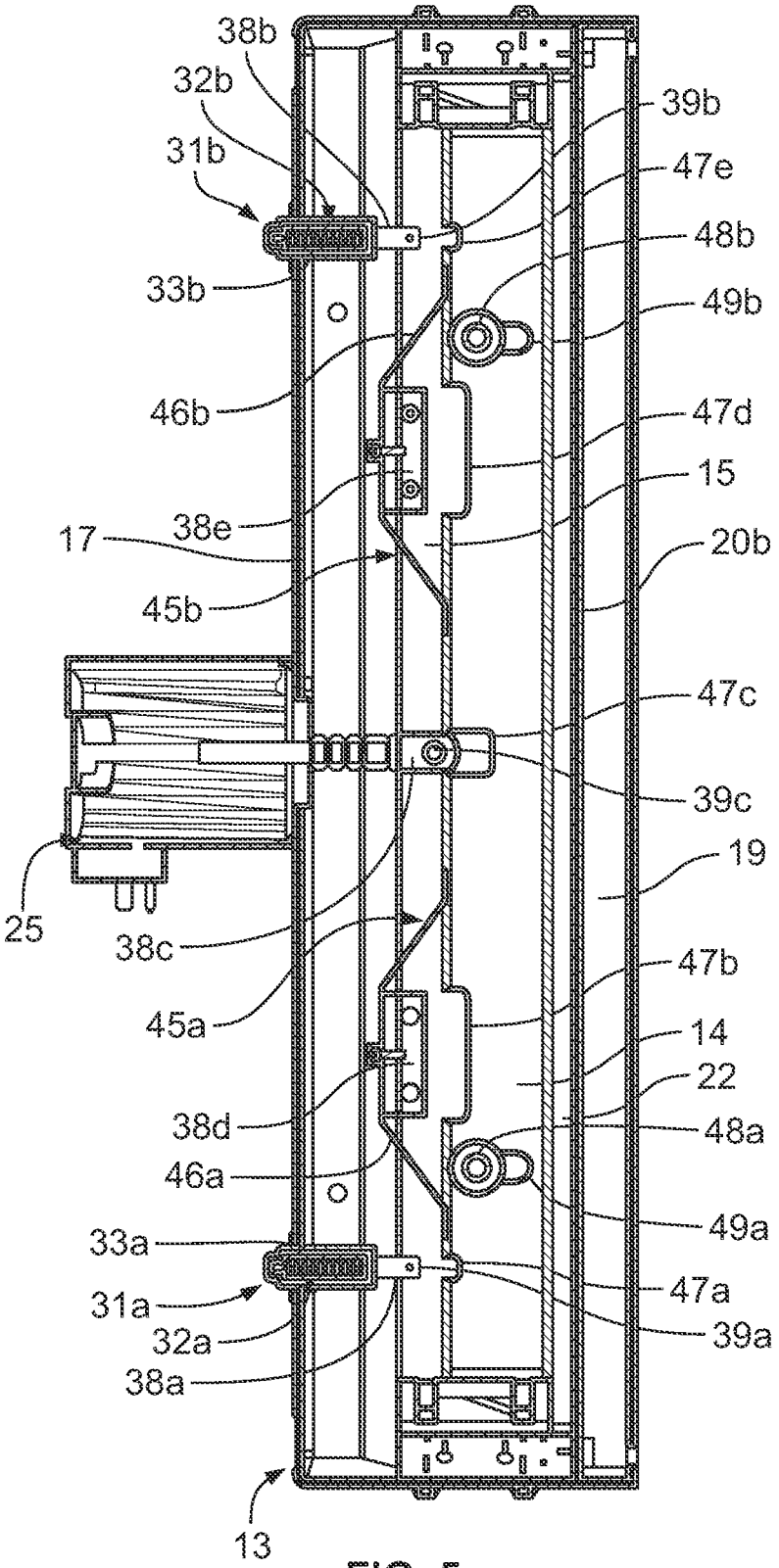
FIG. 5 is a plan view of the pressure magnet, the film guide element and the cutting device in the rest position and with the blade in the first blade position.

FIG. 5 shows a plan view of the pressure magnet 25, the film guide element 19 and the cutting device 13 in the rest position 40 (see FIG. 2). In particular the blade 15, the contact face 20*b* of the film guide element 19 and the film feed gap 22 are shown. A return mechanism 31*a*, 31*b*, with in each case a first elastic element 32*a*, 32*b* in the form of a compression spring 33*a*, 33*b*, is arranged in each case along the blade 15 on each side of the pressure magnet 25. Each return mechanism 31*a*, 31*b* and the pressure magnet 25 is permanently connected to the blade 15 via a coupling element 38*a*, 38*b*, 38*c* on the respective rod 26, 34*a*, 34*b* (see FIG. 6) and a bolt 39*a*, 39*b*, 39*c*. The blade 15 is connected to the blade guide 14 by second elastic elements 45*a*, 45*b* in the form of leaf springs 46*a*, 46*b*. The leaf springs 46*a*, 46*b* are attached to the blade 15 via coupling elements 38*d*, 38*e* of the leaf springs 46*a*, 46*b*. The coupling elements 38*a*-38*e* during the movement of the blade 15 in the cutting direction 27 can be introduced into recesses 47*a*, 47*b*, 47*c*, 47*d*, 47*e* of the blade guide 14. Slide blocks 48*a*, 48*b* are attached to the blade 15 which are moved within slide guides 49*a*, 49*b* in the blade guide 14 and are guided along in the housing 17 that surrounds the cutting device 13. As a result, the slide blocks 48*a*, 48*b* ensure centering of the blade 15. They further assist the return movement of the blade guide 14 after the pressure magnet 25 is switched off.

Figure 6:
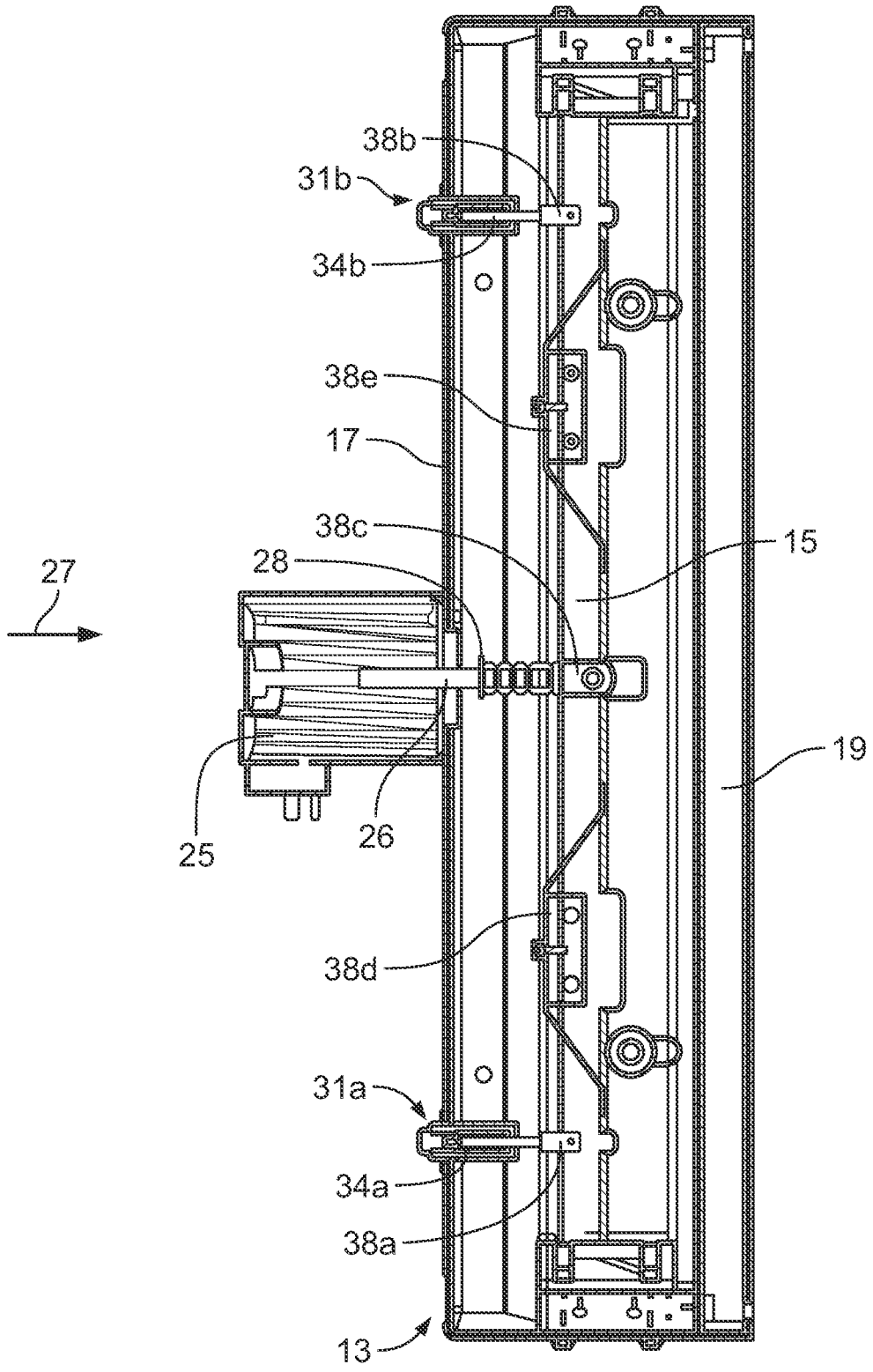
FIG. 6 is a plan view of the pressure magnet, the film guide element and the cutting device in the extended position and with the blade in the first blade position.

FIG. 6 shows a plan view of the pressure magnet 25, the film guide element 19 and the cutting device 13 in the extended position 41 (see FIG. 3). The blade 15 reaches through the film feed gap 22 (see FIG. 5). The rods 26, 34*a*, 34*b* of the return mechanisms 31*a*, 31*b* and of the pressure magnet 25 are extended. The coupling elements 38*a*-38*e* of the return mechanisms 31*a*, 31*b* and the stop 28 of the pressure magnet 25 in each case are at a distance from the housing 17 of the cutting device 13 in the cutting direction 27.

Figure 7:
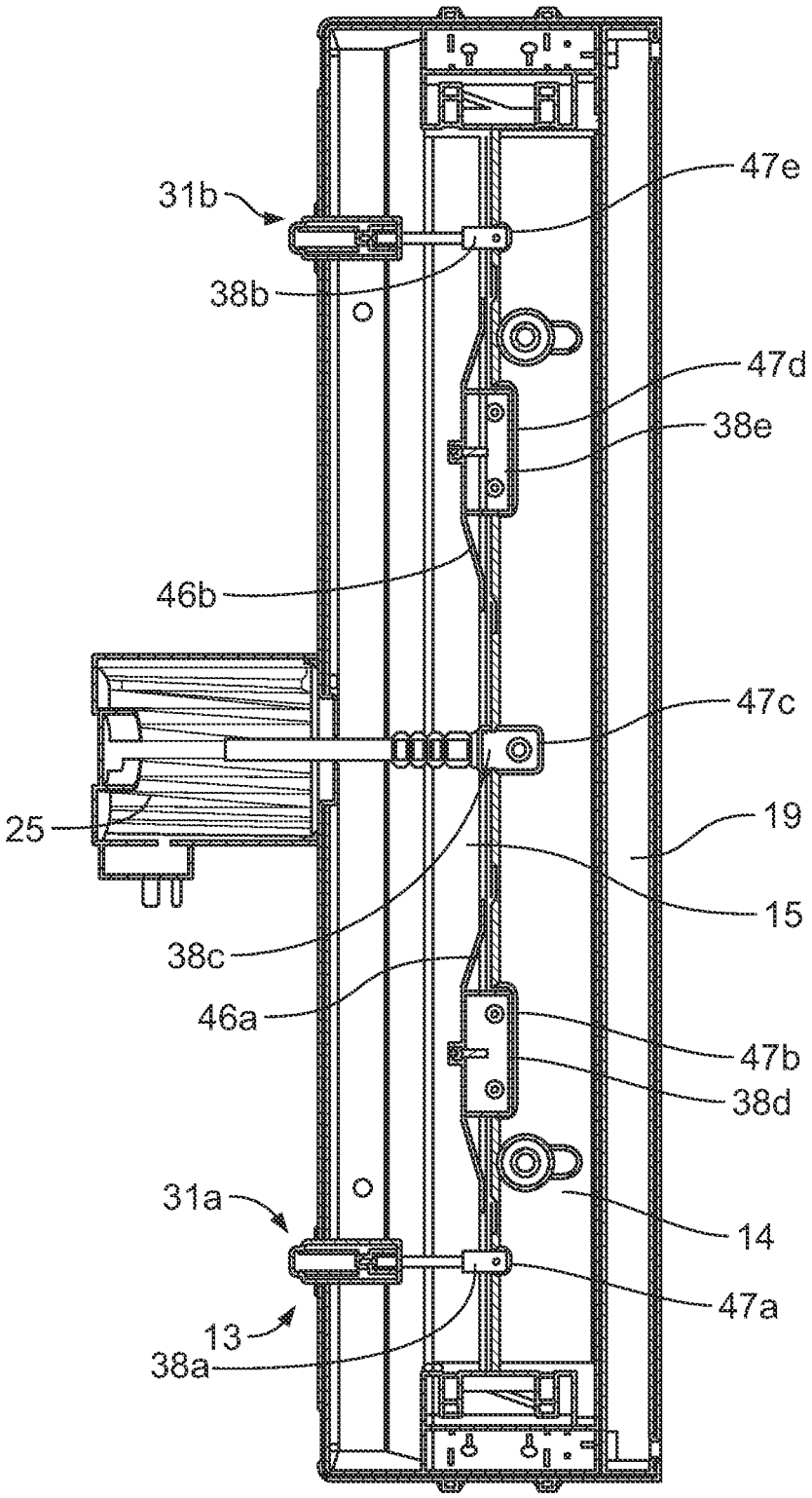
FIG. 7 is a plan view of the pressure magnet, the film guide element and the cutting device in the extended position, wherein the blade is in the second blade position.

FIG. 7 shows a plan view of the pressure magnet 25, the film guide element 19 and the cutting device 13 in the extended position 41 (see FIG. 3), the blade 15 being in the second blade position 44 (see FIG. 4). The coupling elements 38*a*-38*e* associated with the return mechanisms 31*a*, 31*b*, with the pressure magnet 25 and with the leaf springs 46*a*, 46*b* are retracted into the respective recesses 47*a*-47*e* of the blade guide 14.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What follows is a listing of reference numbers used herein:

9 Drive
10 Packaging machine
11 Film feeder
12 Film transport device
13 Cutting device
14 Blade guide
14*a,b* Guide plates
15 Blade
16*a,b* Spacers
17 Housing
19 Film guide element
20*a,b* Contact faces
22 Film feed gap
23 Cutting gap
24 Screw
25 Pressure magnet
26 Pressure magnet rod
27 Cutting direction
28 Stop of the pressure magnet
30 Opposite direction to cutting direction
31*a,b* Return mechanism
32*a,b* First elastic element
33*a,b* Compression spring
34*a,b* Rod of the return mechanism
35*a* Stop for the compression spring
37 End of the rod of the return mechanism
38*a-e* Coupling elements
39*a,b,c* Bolt
40 Rest position
41 Extended position
42 Distance
43 First blade position

44 Second blade position
45*a,b* Second elastic elements
46*a,b* Leaf springs
47*a-e* Recesses in the blade guide
48*a,b* Slide blocks
49*a,b* Slide guides

The invention claimed is:

1. A packaging machine for packaging packaged items using a stretchable film, the packaging machine comprising:
- a film transporter for feeding the stretchable film to a packaging item to be packaged; and
- a cutting device with a blade for cutting the stretchable film from the film transporter to size,
- wherein the cutting device is transferrable by a drive with a driving force from a rest position into an extended position,
- wherein the stretchable film is severable by the cutting device in the extended position,
- wherein the cutting device is connected to a housing surrounding the cutting device via a return mechanism spatially separate from the drive,
- wherein the return mechanism is activatable upon the cutting device being transferred from the rest position into the extended position,
- wherein a return force, which is opposite to that of the driving force, is exertable by the return mechanism in an activated state on the cutting device in its extended position, the force being greater than a return resistance of the cutting device in its extended state by which the cutting device is held in the extended state without action of the driving force,
- wherein the cutting device has a blade guide comprising one or more guide plates, and
- wherein the return mechanism comprises a second elastic element in the form of a leaf spring, having one end fastened to the blade guide and with a second end fastened to the blade.

2. The packaging machine according to claim 1, wherein the return mechanism has a first elastic element, which is fastened indirectly to the blade of the cutting device.

3. The packaging machine according to claim 2, wherein the first elastic element is a compression spring.

4. The packaging machine according to claim 3, wherein the compression spring is connected to the cutting device by a rod.

5. The packaging machine according to claim 2, wherein the packaging machine has further elastic elements in the form of at least one compression spring and/or at least one leaf spring.

6. The packaging machine according to claim 1, wherein the blade is transferable from a first blade position within the blade guide into a second blade position by tensioning the second elastic element, in the second blade position, the blade projects beyond the blade guide and in which the blade is transferable from the second blade position back into the first blade position by relaxing the second elastic element.

7. The packaging machine according to claim 1, wherein the film transporter has a film guide with a cutting gap which is separated from the cutting device in the rest position by a film feed gap, the cutting device resting against the film guide in the extended position.

8. The packaging machine according to claim 7, wherein in the extended position of the cutting device, in particular of the blade guide, the blade projects through the cutting gap of the film guide.

9. The packaging machine according to claim 7, wherein the film guide has contact faces at the cutting gap for the attachment of the stretchable film.

10. The packaging machine according to claim 1, wherein the blade guide has at least one slide guide for at least one slide block formed on the blade.

11. The packaging machine according to claim 10, wherein at least one spacer is arranged between the blade guide and the housing surrounding the cutting device, which can be guided along the housing of the cutting device during the transfer of the cutting device from the rest position into the extended position.

12. The packaging machine according to claim 11, wherein the slide block is arranged on the housing, extends through the spacer and engages in the slide guide of the blade guide.

13. The packaging machine according to claim 12, wherein the slide block reaches through two mutually opposite spacers and engages the slide guide of the blade guide.

14. The packaging machine according to claim 1, wherein the drive has a pressure magnet.

15. The packaging machine according to claim 14, wherein the pressure magnet acts only in the cutting direction of the cutting device.

16. The packaging machine according to claim 1, wherein the drive and/or the return mechanism has coupling elements for connection to the blade.

17. The packaging machine according to claim 16, wherein the coupling elements have a curved cross profile and are insertable into recesses in the blade guide and are configured to grip around the blade.

18. The packaging machine according to claim 1, wherein the guide plates are in the form of two mutually opposite guide plates.

19. A packaging machine for packaging packaged items using a stretchable film, the packaging machine comprising:
- a film transporter for feeding the stretchable film to a packaging item to be packaged; and
- a cutting device with a blade for cutting the stretchable film from the film transporter to size,
- wherein the cutting device is transferrable by a drive with a driving force from a rest position into an extended position,
- wherein the stretchable film is severable by the cutting device in the extended position,
- wherein the cutting device is connected to a housing surrounding the cutting device via a return mechanism spatially separate from the drive,
- wherein the return mechanism is activatable upon the cutting device being transferred from the rest position into the extended position,
- wherein a return force in a direction of the rest position is exertable by the return mechanism in an activated state on the cutting device in its extended position, the force being greater than a return resistance of the cutting device in its extended state by which the cutting device is held in the extended state without action of the driving force, and
- wherein the cutting device has a blade guide comprising one or more guide plates,
- wherein the blade guide has at least one slide guide for at least one slide block formed on the blade, and
- wherein at least one spacer is arranged between the blade guide and the housing surrounding the cutting device, which can be guided along the housing of the cutting device during the transfer of the cutting device from the rest position into the extended position.

20. A packaging machine for packaging packaged items using a stretchable film, the packaging machine comprising:

a film transporter for feeding the stretchable film to a packaging item to be packaged; and a cutting device with a blade for cutting the stretchable film from the film transporter to size, wherein the cutting device is transferrable by a drive with a driving force from a rest position into an extended position, wherein the stretchable film is severable by the cutting device in the extended position, wherein the cutting device is connected to a housing surrounding the cutting device via a return mechanism spatially separate from the drive, wherein the return mechanism is activatable upon the cutting device being transferred from the rest position into the extended position, wherein a return force in a direction of the rest position is exertable by the return mechanism in an activated state on the cutting device in its extended position, the force being greater than a return resistance of the cutting device in its extended state by which the cutting device is held in the extended state without action of the driving force, wherein the drive and/or the return mechanism has coupling elements for connection to the blade, wherein the coupling elements have a curved cross profile and are insertable into recesses in the blade guide and are configured to grip around the blade.

* * * * *